US008240518B2

(12) United States Patent
Canfield

(10) Patent No.: US 8,240,518 B2
(45) Date of Patent: Aug. 14, 2012

(54) DISPENSING DEVICE AND CONTAINER FOR A COSMETIC LIQUID

(75) Inventor: Reiker Canfield, Crystal Lake, IL (US)

(73) Assignee: Seaquist Perfect Dispensing GmbH, Dortmund (DE)

( * ) Notice: Subject to any disclaimer, the term of this patent is extended or adjusted under 35 U.S.C. 154(b) by 681 days.

(21) Appl. No.: 12/300,924

(22) PCT Filed: May 16, 2007

(86) PCT No.: PCT/EP2007/004380

§ 371 (c)(1),
(2), (4) Date: Feb. 17, 2009

(87) PCT Pub. No.: WO2007/131790

PCT Pub. Date: Nov. 22, 2007

(65) Prior Publication Data

US 2009/0166383 A1 Jul. 2, 2009

(30) Foreign Application Priority Data

May 16, 2006 (DE) ..... 10 2006 023 114
Jul. 5, 2006 (DE) ..... 10 2006 031 412
May 9, 2007 (WO) ..... PCT/EP2007/004103

(51) Int. Cl.
*B65D 37/00* (2006.01)
*B05B 11/06* (2006.01)

(52) U.S. Cl. ..... 222/207; 222/95; 222/386; 222/386.5; 222/632; 222/633; 222/209; 222/212; 222/105

(58) Field of Classification Search ..... 222/207, 222/95, 386, 632, 633, 209, 212
See application file for complete search history.

(56) References Cited

U.S. PATENT DOCUMENTS 2,500,687 A * 3/1950 Kamp et al. ..... 222/48
2,721,010 A 10/1955 Meshberg
2,736,930 A 3/1956 Longley
2,812,884 A 11/1957 Ward
2,837,249 A 6/1958 Meshberg (Continued)

FOREIGN PATENT DOCUMENTS

DE 2043415 9/1970

(Continued)

OTHER PUBLICATIONS

International Search Report prepared by the European Patent Office on Dec. 12, for International Application No. PCT/EP2007/004380; Applicant, Seaquist Perfect Dispensing GMBH.

(Continued)

*Primary Examiner* — Kevin P Shaver
*Assistant Examiner* — Nicholas Weiss
(74) *Attorney, Agent, or Firm* — Jason H. Vick; Sheridan Ross, PC

(57) ABSTRACT

The invention relates to a dispensing device for dispensing a cosmetic liquid, the device having an elastic or flexible pump section. A dispensing device is provided having a compact and simple structure that is easy to use and operate such that the dispensing direction is generally different from the direction of actuation. A widening receiving area may be provided for the dispensed liquid that adjoins the outlet such that the liquid can be removed or extracted manually. The receiving area is preferably shell-shaped and open towards the top.

24 Claims, 3 Drawing Sheets

U.S. PATENT DOCUMENTS

| | | | | | |
|---|---|---|---|---|---|
| 2,884,164 | A | | 4/1959 | Kleid | |
| 2,980,301 | A | | 4/1961 | Gorter | |
| 3,018,928 | A | | 1/1962 | Meshberg | |
| 3,073,489 | A | | 1/1963 | Friedman | |
| 3,104,785 | A | | 9/1963 | Beard, Jr. | |
| 3,131,834 | A | | 5/1964 | Meshberg | |
| 3,258,369 | A | | 6/1966 | Blaich | |
| 3,385,482 | A | | 5/1968 | Frangos | |
| 3,507,586 | A | | 4/1970 | Gronemeyer et al. | |
| 3,511,418 | A | | 5/1970 | Venus, Jr. | |
| 3,542,253 | A | | 11/1970 | Weber et al. | |
| 3,608,830 | A | | 9/1971 | Ramella | |
| 3,672,543 | A | | 6/1972 | Roper et al. | |
| 3,698,961 | A | | 10/1972 | Niemann | |
| 3,706,393 | A | | 12/1972 | Curtis et al. | |
| 3,726,442 | A | | 4/1973 | Davidson et al. | |
| 3,795,350 | A | | 3/1974 | Shay | |
| 3,796,356 | A | | 3/1974 | Venus, Jr. | |
| 3,931,831 | A | | 1/1976 | French | |
| 3,961,725 | A | | 6/1976 | Clark | |
| 3,991,916 | A | | 11/1976 | Del Bon | |
| 4,035,303 | A | | 7/1977 | Ufferfilge | |
| 4,099,651 | A | | 7/1978 | Von Winckelmann | |
| 4,222,501 | A | | 9/1980 | Hammett et al. | |
| 4,304,749 | A | | 12/1981 | Bauer | |
| 4,352,443 | A | | 10/1982 | Libit | |
| 4,387,833 | A | | 6/1983 | Venus, Jr. | |
| 4,416,602 | A | | 11/1983 | Neumeister | |
| 4,423,829 | A | | 1/1984 | Katz | |
| 4,458,832 | A | | 7/1984 | Corsette | |
| 4,564,130 | A | * | 1/1986 | Eulenburg | 222/207 |
| 4,830,229 | A | * | 5/1989 | Ball | 222/209 |
| 4,867,347 | A | | 9/1989 | Wass et al. | |
| 4,875,604 | A | | 10/1989 | Czech | |
| 4,892,231 | A | * | 1/1990 | Ball | 222/207 |
| 4,919,312 | A | | 4/1990 | Beard et al. | |
| 4,969,577 | A | | 11/1990 | Werding | |
| 5,007,556 | A | | 4/1991 | Lover | |
| 5,007,596 | A | | 4/1991 | Iwahashi | |
| 5,096,098 | A | | 3/1992 | Garcia | |
| 5,197,637 | A | * | 3/1993 | Naumann | 222/207 |
| 5,221,724 | A | | 6/1993 | Lie et al. | |
| 5,271,432 | A | * | 12/1993 | Gueret | 137/854 |
| 5,301,850 | A | * | 4/1994 | Gueret | 222/494 |
| 5,360,145 | A | * | 11/1994 | Gueret | 222/190 |
| 5,413,250 | A | * | 5/1995 | Gueret | 222/105 |
| 5,454,488 | A | * | 10/1995 | Geier | 222/95 |
| 5,465,872 | A | * | 11/1995 | Gueret | 222/95 |
| 5,492,252 | A | * | 2/1996 | Gueret | 222/207 |
| 5,505,341 | A | * | 4/1996 | Gueret | 222/207 |
| 5,509,582 | A | | 4/1996 | Robbins, III | |
| 5,687,884 | A | | 11/1997 | Bodin et al. | |
| 5,728,333 | A | | 3/1998 | Tabata et al. | |
| 5,732,855 | A | | 3/1998 | Van der Heijden | |
| 5,743,441 | A | | 4/1998 | Baudin et al. | |
| 5,769,283 | A | | 6/1998 | Owada et al. | |
| 5,857,224 | A | | 1/1999 | Oberg et al. | |
| 5,862,955 | A | * | 1/1999 | Albini et al. | 222/212 |
| 5,868,287 | A | | 2/1999 | Kurolkawa et al. | |
| 5,873,491 | A | | 2/1999 | Garcia et al. | |
| 5,875,936 | A | * | 3/1999 | Turbett et al. | 222/207 |
| 5,875,939 | A | | 3/1999 | Geier | |
| 5,881,929 | A | | 3/1999 | Coerver, Jr. | |
| 5,927,568 | A | | 7/1999 | De Nervo et al. | |
| 5,975,381 | A | | 11/1999 | Revenu | |
| 6,007,914 | A | | 12/1999 | Joseph et al. | |
| 6,083,450 | A | | 7/2000 | Safian | |
| 6,112,953 | A | | 9/2000 | Gueret | |
| 6,116,475 | A | | 9/2000 | Delage | |
| 6,145,707 | A | | 11/2000 | Baudin | |
| 6,216,916 | B1 | | 4/2001 | Maddox et al. | |
| 6,298,960 | B1 | | 10/2001 | Derr | |
| 6,322,542 | B1 | | 11/2001 | Nilson et al. | |
| 6,328,920 | B1 | | 12/2001 | Uchiyama et al. | |
| 6,352,184 | B1 | | 3/2002 | Stern et al. | |
| 6,756,004 | B2 | | 6/2004 | Davis et al. | |
| 6,778,089 | B2 | | 8/2004 | Yoakum | |
| 6,832,704 | B2 | | 12/2004 | Smith | |
| 6,919,114 | B1 | | 7/2005 | Darras et al. | |
| 6,966,465 | B2 | | 11/2005 | Kang | |
| 7,264,142 | B2 | * | 9/2007 | Py | 222/321.7 |
| 7,780,045 | B2 | | 8/2010 | Rossignol | |
| 7,854,355 | B2 | | 12/2010 | Rossignol | |
| 2002/0037179 | A1 | | 3/2002 | Suzuki et al. | |
| 2002/0051314 | A1 | | 5/2002 | Hayashi | |
| 2002/0074355 | A1 | | 6/2002 | Lewis et al. | |
| 2002/0190085 | A1 | | 12/2002 | Stanford | |
| 2003/0071080 | A1 | | 4/2003 | Yquel | |
| 2003/0230603 | A1 | | 12/2003 | Smith | |
| 2005/0155980 | A1 | | 7/2005 | Neuhalfen | |
| 2006/0060618 | A1 | | 3/2006 | Hoepner et al. | |
| 2006/0231519 | A1 | | 10/2006 | Py et al. | |
| 2007/0228082 | A1 | | 10/2007 | Jasper et al. | |
| 2007/0272767 | A1 | | 11/2007 | Niggemann | |
| 2008/0110941 | A1 | | 5/2008 | Foster et al. | |
| 2008/0197152 | A1 | | 8/2008 | Neuhaus et al. | |
| 2009/0212075 | A1 | | 8/2009 | Neuhaus et al. | |
| 2009/0294480 | A1 | | 12/2009 | Canfield | |
| 2009/0314810 | A1 | | 12/2009 | Neuhaus | |
| 2010/0012680 | A1 | | 1/2010 | Canfield et al. | |
| 2010/0038385 | A1 | | 2/2010 | Jasper | |
| 2010/0108722 | A1 | | 5/2010 | Canfield et al. | |
| 2010/0147898 | A1 | | 6/2010 | Blumenstein et al. | |

FOREIGN PATENT DOCUMENTS

| | | | |
|---|---|---|---|
| DE | 2920497 | | 11/1980 |
| DE | 9307083 | | 7/1993 |
| DE | 4210225 | | 9/1993 |
| DE | 19851659 | | 11/1998 |
| DE | 29820894 | | 1/1999 |
| DE | 19744510 | | 4/1999 |
| DE | 19832824 | | 2/2000 |
| DE | 19950512 | | 5/2001 |
| DE | 20203841 | | 6/2002 |
| DE | 10308727 | | 6/2004 |
| DE | 202004011219 | | 11/2004 |
| DE | 202004011220 | | 11/2004 |
| DE | 20200512684 | | 11/2005 |
| EP | 0058700 | | 9/1982 |
| EP | 0069738 | | 1/1983 |
| EP | 0179538 | | 4/1986 |
| EP | 0320510 | | 6/1989 |
| EP | 0442858 | | 8/1991 |
| EP | 0599301 | A1 | 6/1994 |
| EP | 0864371 | | 9/1998 |
| EP | 0893356 | A | 1/1999 |
| EP | 0908395 | | 4/1999 |
| EP | 0930102 | | 7/1999 |
| EP | 1084669 | | 3/2001 |
| EP | 1327478 | | 7/2003 |
| EP | 1637232 | | 3/2006 |
| FR | 1266391 | | 7/1961 |
| FR | 2127774 | | 10/1972 |
| FR | 2510069 | | 1/1983 |
| FR | 2654079 | | 11/1989 |
| FR | 2783667 | | 3/2000 |
| FR | 2838108 | | 10/2003 |
| GB | 1405546 | | 8/1972 |
| GB | 1523732 | | 9/1978 |
| GB | 2083142 | A | 3/1982 |
| GB | 2105729 | | 3/1983 |
| GB | 2150226 | | 6/1985 |
| GB | 2155435 | | 9/1985 |
| GB | 2161222 | | 1/1986 |
| JP | 07251884 | | 3/1995 |
| JP | 09039467 | | 2/1997 |
| WO | WO 96/16746 | | 6/1996 |
| WO | WO 00/26007 | | 5/2000 |
| WO | WO 00/44505 | | 8/2000 |
| WO | WO 01/25116 | | 4/2001 |
| WO | WO 02/079679 | | 10/2002 |
| WO | WO 2004/022143 | | 3/2004 |
| WO | WO 2004/073871 | | 9/2004 |
| WO | WO 2004/073877 | | 9/2004 |
| WO | WO 2005/000731 | | 1/2005 |
| WO | WO 2005/123542 | | 12/2005 |
| WO | WO 2005/123543 | | 12/2005 |

| | | |
|---|---|---|
| WO | WO 2006/123168 | 11/2006 |
| WO | WO 2006/128574 | 12/2006 |
| WO | WO 2007/062824 | 6/2007 |
| WO | WO 2007/104561 | 9/2007 |
| WO | WO 2009/030393 | 3/2009 |

OTHER PUBLICATIONS

Written Opinion for International (PCT) Patent Application No. PCT/EP2007/004380, mailed Nov. 16, 2008.

International Preliminary Report on Patentability for International (PCT) Patent Application No. PCT/EP2007/004380, issued Nov. 17, 2008.

U.S. Appl. No. 12/303,807, filed Apr. 1, 2010, Neuhaus et al.

U.S. Appl. No. 12/600,219, filed Mar. 13, 2010, Canfield et al.

U.S. Appl. No. 12/675,204, filed Apr. 29, 2010, Sonntag.

U.S. Appl. No. 12/675,229, filed Apr. 27, 2010, Bernhard.

Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

* cited by examiner

DISPENSING DEVICE AND CONTAINER FOR A COSMETIC LIQUID

CROSS REFERENCE TO RELATED APPLICATIONS

This application is a national stage application under 35 U.S.C. 371 of PCT Application No. PCT/EP2007/004380 having an international filing date of 16 May 2007, which designated the United States, which PCT application claimed the benefit of Germany Application Nos. 10 2006 023 114.7 filed May 16, 2006; 10 2006 031 412.3 filed Jul. 5, 2006; and PCT/EP07/4103 filed May 9, 2007, the entire disclosures of which are hereby incorporated herein by reference.

In the present invention, the term "dispensing device" is to be particularly understood as a dosing pump or hand-operated pump for the dispensing of a preferably cosmetic liquid. However, it can also be any other dispensing device such as a container, dispensing or spray head, dispenser or the like, particularly for a cosmetic liquid.

The term "cosmetic liquid" is to be understood, in a narrower sense, as cosmetics, hair spray, hair lacquer, a deodorant, a foam, a gel, a color spray, a sun protection or skin care agent or the like. Preferably, however, in a broader sense, other body care products, cleaning products particularly for the human body, washing gels, lotions or the like, and even suspensions and fluids, particularly those with gas phases, are included as well. Moreover, other liquids, for example air improvers and particularly technical liquids and fluids as well such as rust-removers and the like, can also be used. Nonetheless, for the sake of simplicity and due to the emphasized use, there is often only mention of cosmetic liquid in the following.

WO 2004/073871 A2 discloses a dispensing device with several pump chambers. Each pump chamber is bordered by an elastically deformable pump part. These pump parts can be deformed by a common actuating element in order to simultaneously dispense different liquids via a likewise common outlet valve.

It is the object of the present invention to provide a dispensing device which is universally usable, has a simple construction and a robust design and/or is simple to operate and can be used, in particular, for very viscous or creamy liquids.

The above object is achieved by a dispensing device as exemplified in the claims. Advantageous modifications are the object of the subclaims.

One aspect of the present invention is that the dispensing device delivers the conveyed liquid at least substantially counter to the direction of actuation and/or vertically in the upward direction. This allows for a simple and compact construction and universal applicability.

Another aspect of the present invention which can also be implemented independently consists in providing a receiving area for delivered liquid which encloses the outlet of the dispensing device—at least in part—and/or is concave or shell-shaped and/or open towards the top. This allows for very simple and intuitive usage or removal of the delivered liquid, particularly using a finger or several fingers and/or by extraction from the receiving area.

Another aspect of the present invention which can also be implemented independently consists, in the case of a dispensing device with a container with the bag located in it for the liquid to be delivered, in extruding the bag into the container and/or coextruding this therewith, with the bag collapsing upon removal of the liquid and therefore being able to separate from the container wall. This allows for especially simple and cost-effective manufacture.

The proposed dispensing device can be used, for example, for a cream, lotion, salve, paste or for air atomizers, air fresheners or other applications, for example for the delivery of a medium from a flat glass, a cup, a bowl or the like. The dispensing device can also be inserted directly into a bowl, a cup or the like. The delivery can occur optionally in liquid and/or atomized form. As needed, it is also possible to switch between the various forms of delivery.

Other advantages, features, characteristics and aspects of the present invention follow from the claims and the following description of a preferred embodiments on the basis of the drawing.

Figure 1:
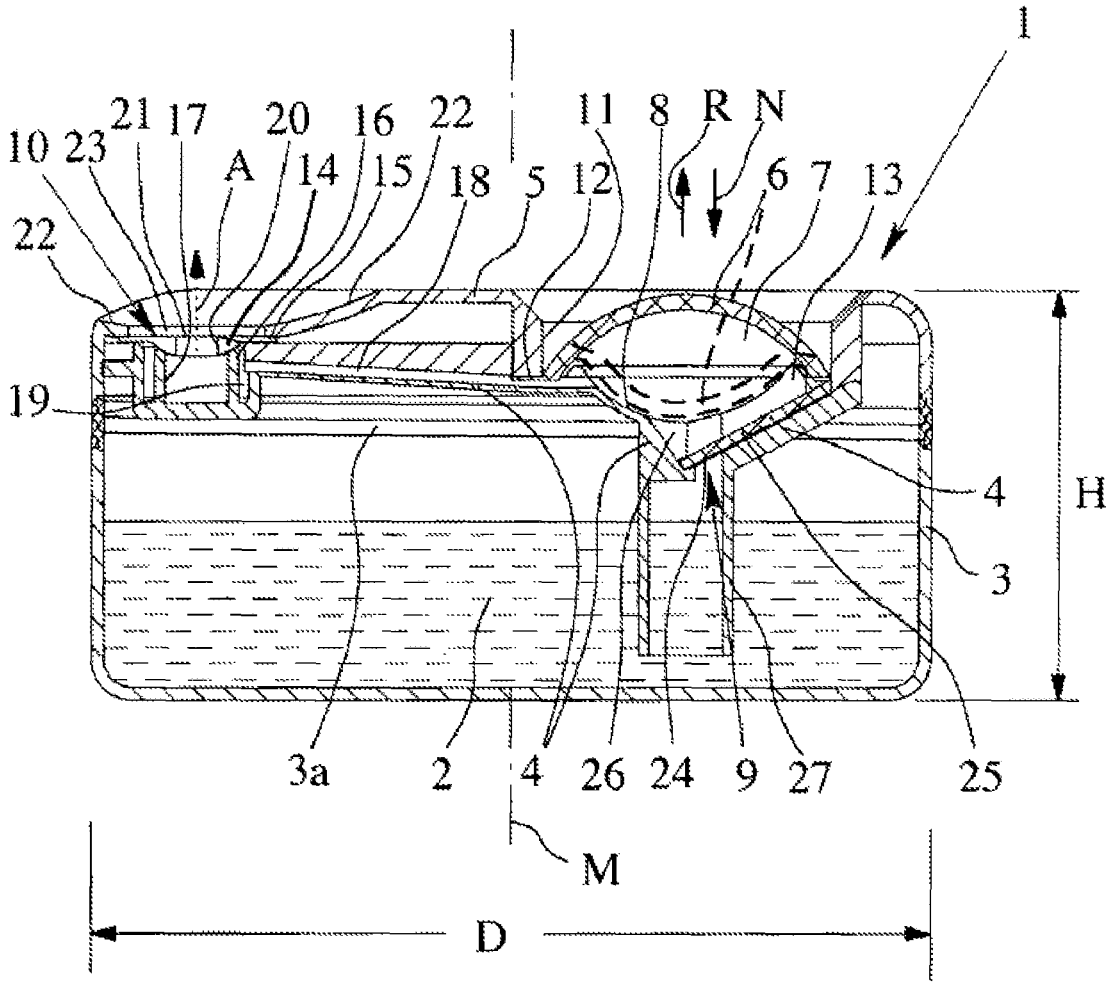
FIG. 1 shows a schematic section of a proposed dispensing device with a container according to a first embodiment.

FIG. 1 shows a proposed dispensing device 1, particularly in the form of a pump, for dispensing a preferably cosmetic liquid 2 in the sense mentioned at the outset. The liquid 2 can be substantially more viscous than water or, optionally, even pasty.

A container 3 for providing liquid 2 to which the dispensing device 1 is preferably detachably connected or vice versa is preferably associated with the dispensing device 1. Accordingly, a switching out of the container 3 or the like and/or a refilling of the liquid 2 can optionally occur. Alternatively, the dispensing device 1 can also form a reservoir for the liquid 2 or form the container 3 itself.

The container 3 is preferably rigid. Particularly, it consists of glass, plastic or another suitable material.

The container 3 is preferably flat and/or cylindrical. Especially preferably, its height H smaller than its diameter D (outer diameter or opening diameter). Particularly, the height H is at most 50% of the diameter D or less.

In the depicted example, the dispensing device 1 preferably forms a cover of the container 3. In this case, the container 3 is preferably not tapered in the area of its opening facing the dispensing device 1. However, it is also possible in principle.

The dispensing device 1 can preferably be screwed to the container 3, particularly via a thread 3*a* on the dispensing device 1 and/or on the container 3, or connected by snapping in place. However, it is also possible for the dispensing device 1 to no longer be detachable from the container 3. In this case, the dispensing device 1 is adhered, welded and/or snapped together therewith.

The dispensing device 1 is preferably embodied such that, in the ready-to-use state, it is arranged at the top on the container 3 and/or the dispensing direction A extends substantially vertically towards the top. However, in principle, the proposed dispensing device 1 can also be used in any orientation and/or with any dispensing direction A and/or also together with other containers 3 or even without containers 3.

Especially preferably, the dispensing direction A extends crosswise, particularly at least substantially perpendicular to the cover of the container 3 and/or to a flat side of the container 3.

Especially preferably, the dispensing device 1 forms a cover of the container 3 and/or is integrated into a cover of the container 3.

The dispensing device 1 preferably has a first component 4, a second component 5 and/or an elastically deformable pump section 6.

The pump section 6 is associated with a pump chamber 7 or borders same. Especially preferably, the pump chamber 7 is at least partially bordered or formed by the pump section 6 and/or a section 8 of the first component 4 preferably forming a bottom.

Accordingly, the pump section 6 is preferably connected indirectly or directly with the first component 4 in a non-detachable, liquid-tight and, particularly, gas-tight manner. In the depicted example, the pump section 6 is preferably held by the second component 5 and connected with the first component 4 via same. However, other constructive solutions are also possible here.

The first and/or second component 4, 5 is preferably designed to be rigid and/or a single piece, and is particularly injection molded from a suitable, preferably food-safe plastic, particularly polyolefin, such as PP (polypropylene) or PE (polyethylene), or manufactured in another manner. The pump section 6, by contrast, is designed to be flexible or elastically deformable and is particularly manufactured from a suitable plastic.

The second component 5 is preferably used to affix or hold the pump section 6. Especially preferably, the pump section 6 is formed by the second component 5 or formed, molded or injection-molded thereon or vice versa.

In the depicted example, the second component 5 is preferably injection-molded onto the pump part 6 or connected non-detachably and liquid-tightly therewith in another manner. This enables simple manufacture, for example by means of so-called "bi-injection," i.e. particularly by means of the injection-molding of another material in the same injection mold in which a first material is formed. Particularly, a chemical and/or mechanical connection is thus made possible.

Alternatively or in addition, the second component 5 can also be connected or held together with the pump section 6 by means of an undercut, recess, through hole, overlap, or the like. Moreover, the pump section 6 and the second component 5 can be embodied or manufactured as separate components.

Preferably, the pump section 6 is designed to be at least substantially dome-like or hemispherical or arched and/or the section 8 of the first component 4 preferably forming a bottom is arranged such that it corresponds thereto or is opposite same and is particularly recessed in order to form or border the pump chamber 7.

The first and/or second component 4, 5 is, as already mentioned, designed to be relatively rigid. By contrast, the pump section 6 is designed to be elastically deformable or flexible in order to make a deformation possible for reducing the size of the pump chamber 7 for the pumping or conveying of the liquid 2. The different materials, as already mentioned, are preferably connected with each other such that a single component or assembly is finally formed. This considerably facilitates assembly. In particular, it is then sufficient to connect the second component 5 with the first component 4. This is preferably done by means of ultrasound welding and/or in another suitable manner.

The dispensing device 1 preferably has an inlet valve 9 and an outlet valve 10. Preferably, the pump part 6 forms the inlet valve 9 and/or outlet valve 10 together with the first component 4. However, the valves 9, 10 can also be formed separately. The valves 9, 10 are preferably embodied as self-closing one-way valves.

When the pump chamber 7 is filled with liquid 2, the volume of the pump chamber 7 can be reduced starting from the resting and initial position shown in the figures through deformation of the pump section 6, hence expelling and dispensing liquid 2 from the pump chamber 7.

The deformation of the pump section 6 is achieved particularly in that a user (not shown) presses directly or indirectly—for example, by means of an actuating element, not shown—thus deforming the pump section 6 to the section 8 or in the direction of depression N elastically or reversibly. In the only figure, the pump section 6 in the deformed or depressed state is indicated with a broken line.

In the depicted example, the pump section 6 is preferably arranged in or on a particularly cylindrical recess 11 of the second component 5. Particularly, in the non-deformed state, the pump section 6 does not protrude over the upper side of the dispensing device 1 or of the second component 5. This is conducive to good stackability without inadvertently deforming the pump section 6 and consequently actuating the dispensing device 1.

In the depicted example, the pump section 6 is preferably held by the particularly cylindrical area of the second component 5, with this area forming the recess 11. In particular, the pump section 6 is held by a preferably annular or flange-like holding section 12 of the second component 5 or connected therewith. As needed, the pump section 6 can also be only accommodated in a clamped manner between the first and second component 4, 5. In this case, however, the pump section 6 is preferably held not only in a nonpositive manner but rather also positively.

In order to facilitate effective pumping and/or to achieve a dead volume in the pump chamber 7 which is as small as possible, the pump section 6 can adjoin the area 8 to the greatest extent possible in the deformed state. For this purpose, a transition 13 is formed from the pump section 6 to the bottom section 8, particularly rounded or bent, particularly formed from the section 8 first component 4. Especially preferably, the transition 13 is convex or is embodied as a preferably continuous collar. The preferably concave bottom area 8 then adjoins the transition 13.

With respect to the direction of depression N, an at least substantially rotationally symmetrical design of the pump chamber 7, of the pump section 6 and/or of the bottom section 8 is preferably provided. However, asymmetrical and, particularly, rotationally non-symmetrical arrangements are also possible here—oblong or elliptic configurations, for example.

During the deformation of the pump section 6 and size-reduction of the pump chamber 7, the liquid 2 not shown in the pump chamber 7 in the figure is delivered or dispensed via the outlet valve 10. In particular, the opening of the outlet valve 10 occurs automatically, preferably as a result of the pressure of the liquid.

In the depicted example, the outlet valve 10 is preferably arranged laterally beside the pump section 6.

The outlet valve 10 has a valve element 14 which is held by a connecting section 15 which is preferably manufactured from flexible or elastically deformable material and/or is embodied in a single piece with the valve element 14.

The connecting section 15 encloses the valve element 14 preferably in the manner of a ring or a flange. The connecting section 15 holds the valve element 14 preferably on an associated valve seat 16 of the outlet valve 10. In the depicted example, the valve seat 16 is particularly annular or embodied as a conical ring. Especially preferably, the valve seat 16 is embodied as the front surface of a recess 17 closed at the end and/or is formed by the first component 4, particularly molded therein.

The opening of the outlet valve 10 occurs particularly through the axial movement of the valve element 14. This is particularly possible by means of elastic deformation of the connecting section 15 or other variable areas.

The outlet valve 10 is preferably connected to the pump chamber 7 via a connection channel 18 and/or via a ring channel enclosing the valve seat 14 radially to the outside and peripherally. During pumping or actuation of the pump section 6, liquid 2 located in the pump chamber 7 is placed under pressure, and leads particularly to a deformation of the connecting section 15 such that the valve element 14 is lifted axially off from the valve seat 16, hence opening the outlet valve 10. The liquid 2 is then able to flow, particularly, axially and/or radially into the recess 17.

Moreover, the dispensing device 1 preferably has a delivery channel 20. Especially preferably, the delivery channel 20 is formed by the valve element 14. Particularly, the valve element 14 is hollow for this purpose and/or is provided with a corresponding passage channel, particularly running axially or in the direction of motion or in dispensing direction A. Preferably, a dispensing opening or an outlet 21 is formed directly from the valve element 14 or delivery channel 20.

When the outlet valve 10 is open or the valve element 14 is lifted off from the valve seat 16, the liquid 2 flowing into the recess 17 is particularly diverted and delivered through the valve element 14 or through the delivery channel 20 and/or the dispensing opening formed thereby. In the depicted example, it is therefore particularly the outlet valve 10 or valve element 14 which serves to directly deliver or dispense the liquid 2. Therefore, in particular, no other channels, diversions, delivery nozzles or the like adjoin the outlet valve 10 or its valve element 14, although this is also possible in principle and, accordingly, is preferably not intended to be ruled out. Particularly, other constructive solutions are also possible. For example, the delivery channel 20 or outlet 21 can also be formed in the conventional manner from another part, for example the second component 5.

The dispensing direction A preferably extends at least counter to the direction of depression N and/or at least substantially parallel to the middle axis M of the dispensing device 1 and/or of the container 3.

After the dispensing of liquid and the respective drop in the pressure of the liquid in the pump chamber 7 or in the ring channel 19, the outlet valve 10 closes again, preferably automatically, particularly as a result of the restorative forces of the connecting section 15. Nonetheless, other constructive solutions are also possible here. For example, a return spring or the like can also be used.

The dispensing device 1 preferably has a receiving area 22 for the dispensed liquid 2 (not shown) which particularly adjoins the outlet 21. The receiving area 22 is particularly shell-shaped or convex. Preferably, it encloses the delivery channel 20 or outlet 21 at least in part, in particular preferably in the manner of a ring or completely. Especially preferably, the receiving area 22 is provided with an opening or cavity or recess 23 in which the delivery channel 20 or outlet 21 is arranged and/or which is covered or sealed by the valve element 14 and/or connecting section 15. However, other constructive solutions are also possible here.

The receiving area 22 is preferably embodied such that dispensed liquid 2—particularly if it is a very viscous or pasty liquid 2 such as a cream, salve, paste or lotion—is accomodated from the receiving area 22 in the ready-to-use state of the dispensing device 1, particularly without any liquid 2 flowing down at the sides. This is particularly possible by virtue of the shell-like structure of the receiving area 22 which is open towards the top. Alternatively or in addition, the pump volume of the dispensing device 1 per actuation is preferably adapted to the receiving area 22 or vice versa, such that the receiving area 22 is preferably able to accommodate a complete pump volume of liquid 2 upon an actuation of the pump section 6.

The receiving area 22 is preferably flat in order to enable or facilitate a preferably manual removal of the dispensed liquid 2, particularly with a finger or several fingers of a user (not shown). In particular, the dispensed liquid 2 can be removed or extracted manually from the receiving area 22. To facilitate an intuitive and/or simple removal of the liquid 2, the receiving area 22 is preferably arranged in an outer edge area or adjacent to a periphery or edge of the dispensing device 1 and/or provided with a lower edge in a lateral area—in the depicted example, preferably in the outer edge area of the dispensing device 1.

In the depicted example, the receiving area 22 is preferably formed by the second component 5 or molded therein. However, other constructive solutions are also possible.

In the depicted example, the receiving area 22 is preferably formed or arranged on the upper side or starting from the upper side of the dispensing device 1. However, other constructive solutions are also possible here.

In the depicted example, the receiving area 22 or the pump section 6 is open or freely accessible. However, other constructive solutions are also possible here. For example, a covering, lid or the like can also be used.

Especially preferably, the receiving area 22 extends at least substantially crossways to the dispensing direction A. However, other constructive solutions are also possible. In particular, it is also possible for the dispensing direction A to run not substantially crossways to the surface of the receiving area 22, but rather at an inclination or even tangentially thereto, for example. In the depicted example, the dispensing direction A could even extend substantially horizontally, for example, so that the receiving area 22 is then optionally fed more from one side. The outlet 21 can optionally end in a lower area, in a lateral area or in an upper edge area of the receiving area 22.

Especially preferably, the receiving area 22 is arranged on a cover of the container 3 and/or flat side of the container 3 or is formed thereby.

After the dispensing of liquid is completed—particularly after the pressing down of the pump section 6 has ended—a preferably automatic return of the pump section 6 into the initial position shown in the figure occurs, with new liquid 2 being taken up, preferably sucked, via the inlet valve 9 into the pump chamber 7. The opening of the inlet valve 9 during the return to the initial position occurs particularly as a result of the negative pressure then prevailing in the pump chamber 7.

The inlet valve 9 is indicated only schematically in the figure. Preferably, it has a valve opening 24 which is covered by a preferably elastically deformable valve flap 25. Preferably, the valve flap 25 is molded onto the pump section 6 or is embodied in a single piece therewith and/or is manufactured from a flexible or elastically deformable material. The valve flap 25 is preferably embodied such that it is pretensioned against the valve opening 24, hence closing the valve opening 24 or the inlet valve 9.

Especially preferably, the inlet valve 9 or the valve flap 25 is formed or arranged with the associated valve opening 24 in a notch 26 in the bottom area 8 of the first component 4. However, other constructive solutions are also possible here.

Upon the return of the pump section 6 in return direction R into the initial position shown in the figures, the outlet valve 10 is closed. Accordingly, negative pressure is formed in the pump chamber 7, so that the valve flap 25 opens inward and thus releases the valve opening 24, hence opening the inlet valve 9.

Upon the return of the pump section 6, liquid 2 is sucked from the container 3 via the opened or opening inlet valve 9 as a result of the negative pressure. Particularly, the dispensing device 1 has a riser 27 for sucking the liquid 2 from the container 3 which is preferably molded directly onto the dispensing device 1 or the first component 4 or the inlet valve 9. The riser 27 preferably extends at least into the vicinity of the bottom of the container 3.

However, other constructive solutions are also possible here. For example, a flexible hose can be connected to a connector (not shown) or the like.

Upon the return of the pump section 6 into the initial position shown in the figure, the pump chamber 7 is again filled with liquid 2. The inlet valve 9 then preferably closes again automatically or at least at the beginning of the next pumping procedure, i.e. upon pressing down of the pump section 6 and then increasing liquid pressure in the pump chamber 7.

In the following, further embodiments of the proposed dispensing device 1 are explained on the basis of the other figures. Particularly, only substantial changes or differences vis-à-vis the previously-explained embodiment are described in further detail in the following, so that, in particular, the previous remarks and explanations apply correspondingly or in addition.

Figure 2:
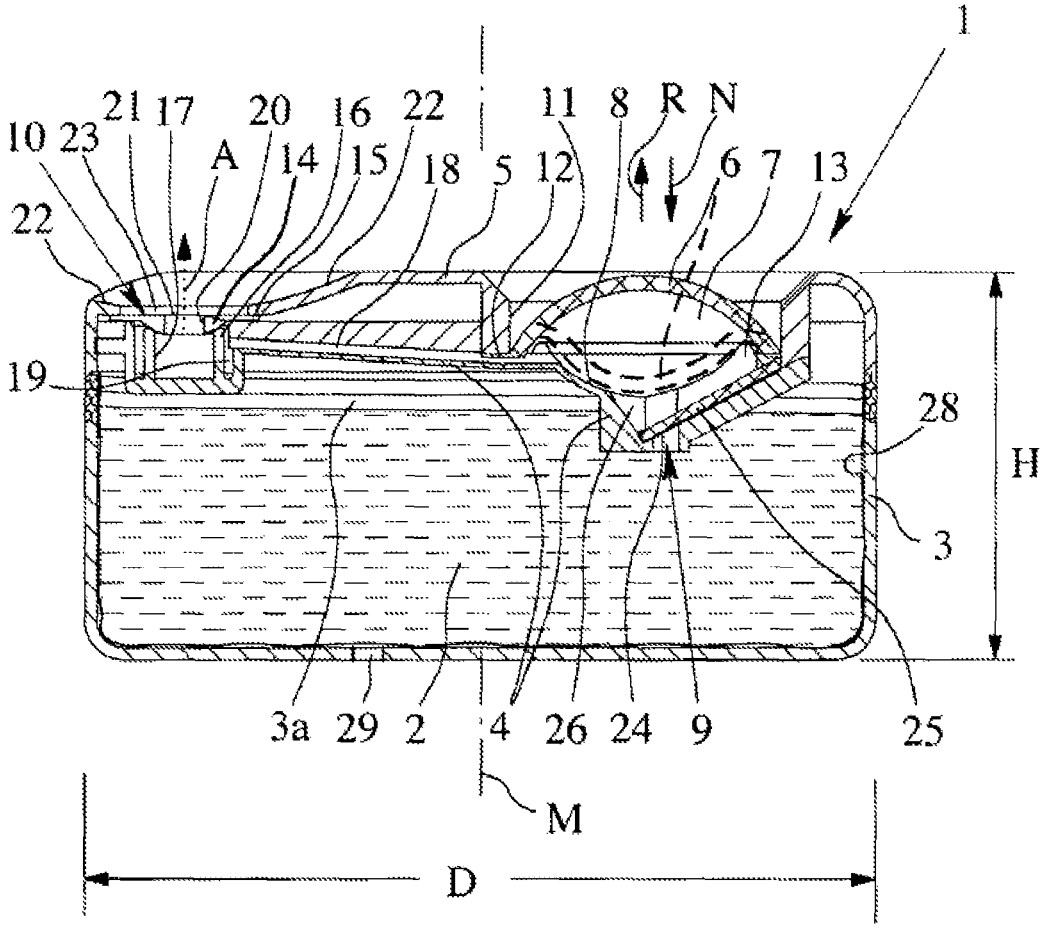
FIG. 2 shows a schematic section of a proposed dispensing device with a container according to a second embodiment.

FIG. 2 shows a second embodiment of the proposed dispensing device 1 in a schematic section corresponding to FIG. 1.

Arranged in the container 1 is a bag 28 in which the liquid 2 can be or is held.

FIG. 2 shows the dispensing device 1 or the container 3 in the completely filled state. Upon removal of the liquid 2, the bag 28 collapses. Particularly, this occurs in that the liquid 2 is sucked from the bag 28. The dispensing device 1 therefore functions as a pump during the removal of the liquid 2.

Especially preferably, a riser 27 for the removal of the liquid 2 from the bag 28 is not required, even if a riser 27 can be used in principle. In the depicted example, the liquid 2 is especially preferably sucked directly via the inlet valve 9 of the dispensing device 1.

The bag 28 is preferably extruded into the container 3 or coextruded therewith. This allows for very simple and also cost-effective manufacture.

The bag 28 is preferably manufactured from an elastic or flexible, particularly film-like material. In particular, the bag 28 is manufactured from a different material than the preferably rigid container 3. In the depicted example, the bag 28 preferably consists of polyethylene and the container 3 preferably of polypropylene.

The materials for the bag 28 on the one hand and the container 3 on the other hand are preferably selected such that they do not connect with each other in principle or at least in substantial areas, so that the bag 28, upon removal of the liquid 2, is able to collapse or contract in the container 3, i.e. detach from the container wall at least in substantial areas or completely.

The bag 28 can, for example, be connected directly with the inlet, a riser 27, the inlet valve 9 or another connection of the dispensing device 1. In the depicted example, however, the bag 28 is not connected therewith, but rather is solidly connected with the container only and/or in areas, particularly along an edge of the bag 28 and/or the container 3. This connection can be achieved, for example, through welding, adhesion, clamping and/or the like. Especially preferably, the connection is achieved through injection, and the preferred connection with the container wall can be achieved only in this desired area of connection and not in the other areas, by treating the container wall in the desired area of connection with plasma before the bag 28 is extruded against it. By means of plasma treatment, it is namely possible to solidly connect materials which cannot otherwise be connected through coextrusion or injection.

In the depicted example, the bag 28 is preferably covered or sealed off together with the container 3 by a cover or another seal which is particularly formed by the dispensing device 1 itself or here by the second component 5 or a pump or the like. This covering or this seal is particularly gas-tight, preferably through welding, particularly by means of ultrasound, in order to prevent an undesirable penetration of ambient air upon removal, particularly sucking of liquid 2. However, other constructive solutions are also possible.

Upon removal of liquid 2, air is able to flow via a vent opening 29 into the inner chamber of the container 3, so that no negative pressure is produced in the container 3 when the bag 28 collapses or contracts.

Figure 3:
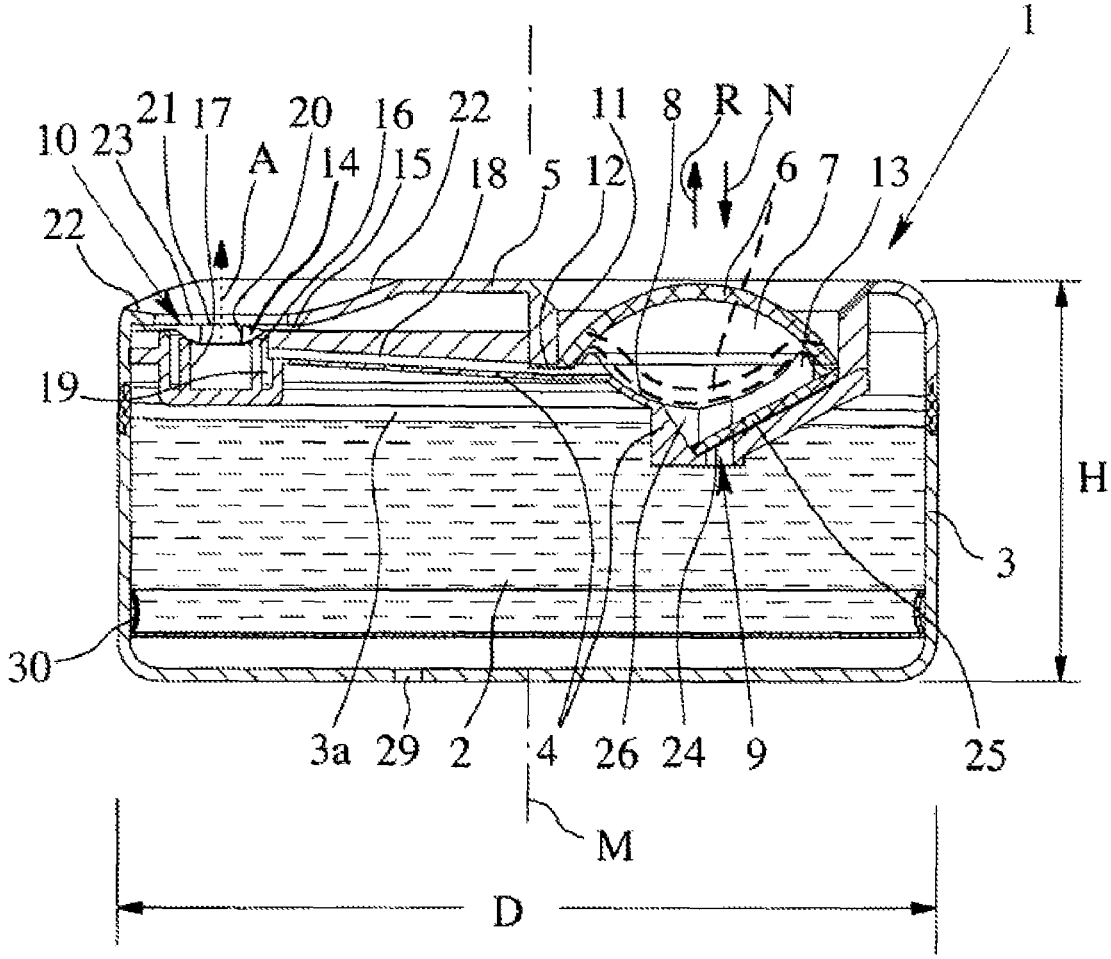
FIG. 3 shows a schematic section of a proposed dispensing device with a container according to a third embodiment.

FIG. 3 shows a third embodiment of the proposed dispensing device 1 which is very similar to the second embodiment. Instead of a bag 28, a movable piston 30 is arranged here in the container 3 or formed thereby. The piston 30 establishes a seal with respect to the inner container wall and moves upon removal of liquid 2 from the container 3, and ambient air is able to flow subsequently onto the side of the piston 30 facing away from the liquid 2, so that no negative pressure occurs in the container 3.

Individual aspects and features of the described embodiments as well of the embodiment itself can also be combined with each other at will or used in other dispensing devices 1.

List of reference symbols:

1 dispensing device 19 ring channel
2 liquid 20 delivery channel
3 container 21 outlet
3*a* thread 22 receiving area
4 first component 23 recess
5 second component 24 valve opening
6 pump section 25 valve flap
7 pump chamber 26 notch
8 bottom section 27 riser
9 inlet valve 28 bag
10 outlet valve 29 vent opening
11 recess 30 piston
12 retaining section
13 transition A dispensing direction
14 valve element D diameter
15 connecting section H height
16 valve seat M middle axis
17 recess N direction of depression
18 connection channel R return direction

The invention claimed is:

1. A dispensing device for dispensing a liquid from a substantially flat or cylindrical container, comprising:

an elastic or flexible pump section which borders a pump chamber for the liquid, or is fluidly connected therewith, an inlet valve associated with the pump chamber, an outlet valve associated with the pump chamber, wherein the liquid can be pumped or conveyed by reversible deformation of the pump section in a direction of depression and dispensed from the pump chamber via the outlet valve in a dispensing direction, wherein the liquid can be subsequently sucked into the pump chamber via the inlet valve by elastic returning of the pump section, wherein the container has a greater diameter than height, wherein the pump section is substantially surrounded by a second component, the second component comprising a rigid portion of a cover above which the pump section does not extend and separating the pump section from the outlet valve;

wherein the dispensing device or the container has a bag with the liquid, wherein the bag collapses upon removal of the liquid; and wherein a maximum height of the dispensing device comprises the second component and the second component extending generally planarly and comprising a height substantially equal to or higher than the height of the pump section in an un-deformed state, wherein a receiving area proximal to the outlet valve extends upwardly toward the second component.

2. The dispensing device as set forth in claim 1, wherein a dispensing direction extends crossways substantially perpendicularly to the cover of the container and/or to a flat side of the container.

3. A dispensing device for dispensing a liquid, with an elastic or flexible pump section which borders a pump chamber for the liquid, or is fluidly connected therewith, comprising an inlet valve associated with the pump chamber and an outlet valve associated with the pump chamber, wherein liquid can be pumped or conveyed through actuation by reversible deformation of the pump section and dispensed from the pump chamber via the outlet valve, wherein liquid can be subsequently sucked into the pump chamber via the inlet valve by elastic returning of the pump section, wherein the dispensing device has a widening receiving area for the dispensed liquid enclosing an outlet, and the liquid can be manually removed or extracted from the receiving area, wherein a pump volume corresponds to a volume of the receiving area, such that the receiving area accommodates a complete pump volume of liquid upon actuation of the pump section, and wherein a maximum height of the dispensing device comprises a second component and wherein the receiving area extends upwardly toward the second component, the second component extending generally planarly and comprising a height substantially equal to or higher than the height of the pump section in an un-deformed state, wherein the receiving area proximal to the outlet valve extends upwardly toward the second component.

4. The dispensing device as set forth in claim 3, wherein the receiving area is concave or shell-shaped and/or is open towards the top.

5. The dispensing device as set forth in claim 3, wherein the receiving area is embodied and the pumping volume and/or viscosity of the liquid is adapted such that the delivered liquid does not run down from the receiving area.

6. The dispensing device as set forth in claim 1, wherein the receiving area is arranged in the cover of the container and/or on a flat side of the container.

7. The dispensing device as set forth in claim 1, wherein the pump section forms the associated inlet valve and/or outlet valve.

8. The dispensing device as set forth in claim 1, wherein the pump section is substantially dome-shaped or hemispherical, or has an area shaped in this manner.

9. The dispensing device as set forth in claim 1, wherein the dispensing device has a riser.

10. The dispensing device as set forth in claim 9, wherein the riser is molded onto the inlet valve and/or extends to the bottom of the container.

11. The dispensing device as set forth in claim 1, wherein the dispensing device and the container can be screwed together.

12. The dispensing device as set forth in claim 1, wherein the dispensing device is welded to the container.

13. The dispensing device as set forth in claim 1, wherein the dispensing device forms the cover of the container and/or is integrated into the cover of the container.

14. The dispensing device as set forth in claim 1, wherein the outlet valve has a valve element which is elastically pretensioned against a dispensing direction and can be moved in the dispensing direction to open the outlet valve.

15. The dispensing device as set forth in claim 1, wherein the dispensing device or the container has or forms a piston which can be moved in the container such that the liquid can be sucked or removed from the container in an air-free manner.

16. The dispensing device as set forth in claim 1, wherein the bag is one or more of extruded into the container and coextruded therewith.

17. A dispensing device for dispensing a liquid, comprising an elastic or flexible pump section which borders a pump chamber for the liquid, or is fluidly connected therewith, an inlet valve associated with the pump chamber, and an outlet valve associated with the pump chamber, wherein liquid can be pumped or conveyed through reversible deformation of the pump section and dispensed from the pump chamber via the outlet valve wherein liquid can be subsequently sucked into the pump chamber via the inlet valve by elastic returning of the pump section, wherein the dispensing device has a widening receiving area for the dispensed liquid enclosing the outlet valve, and the liquid can be manually removed or extracted from the receiving area, wherein the receiving area comprises a lower edge proximal a lateral area of the device, wherein a pump volume corresponds to a volume of the receiving area, such that the receiving area accommodates a complete pump volume of liquid upon actuation of the pump section, wherein a maximum height of the dispensing device comprises a second component, wherein the receiving area extends upwardly from the lower edge toward the second component, the second component extending generally planarly in at least one direction away from the receiving area and comprising a height substantially equal to or higher than the height of the pump section in an un-deformed state, and wherein the receiving area proximal to the outlet valve extends upwardly toward the second component.

18. A dispensing device for dispensing a liquid, comprising an elastic or flexible pump section which borders a pump chamber for the liquid, or is fluidly connected therewith, an inlet valve associated with the pump chamber, and an outlet valve associated with the pump chamber, wherein liquid can be pumped or conveyed through reversible deformation of the pump section in a direction of depression and dispensed from the pump chamber via the outlet valve in a dispensing direction , wherein the liquid can be subsequently sucked into the pump chamber via the inlet valve by elastic returning of the pump section, wherein the dispensing device has a widening receiving area for the dispensed liquid enclosing an outlet, and the liquid can be manually removed or extracted from the receiving area, wherein the receiving area comprises an upper portion, the height of said upper portion being lower than a maximum height of the dispensing device, wherein the pump volume corresponds to the volume of the receiving area, such that the receiving area accommodates a complete pump volume of the liquid upon actuation of the pump section, wherein the maximum height of the dispensing device comprises a second component and wherein the receiving area extends upwardly toward the second component, the second component extending generally planarly and comprising a height substantially equal to or higher than the height of the pump section in an undeformed state, wherein the receiving area proximal to the outlet valve extends upwardly toward the second component.

19. The dispensing device of claim 18, wherein the pump section, when the pump section is not in a deformed state, is less than the maximum height of the dispensing device.

20. The dispensing device of claim 18, wherein the receiving area extends upwardly toward the second component in a curved manner.

21. The dispensing device of claim 1, wherein the pump section, when the pump section is not in a deformed state, is less than the maximum height of the dispensing device.

22. The dispensing device of claim 1, wherein a receiving area proximal to the outlet valve extends upwardly toward the second component in a curved manner.

23. The dispensing device of claim 3, wherein the pump section, when the pump section is not in a deformed state, is less than the maximum height of the dispensing device.

24. The dispensing device of claim 3, wherein the maximum height of the dispensing device comprises the second component and wherein the receiving area extends upwardly toward the second component in a curved manner.

* * * * *